US007707717B2

(12) United States Patent
Pringle

(10) Patent No.: US 7,707,717 B2
(45) Date of Patent: May 4, 2010

(54) METHOD FOR REPAIRING AN ELECTRODE ASSEMBLY

(75) Inventor: Earnest Pringle, Acworth, GA (US)

(73) Assignee: Healthtronics, Inc., Austin, TX (US)

( * ) Notice: Subject to any disclaimer, the term of this patent is extended or adjusted under 35 U.S.C. 154(b) by 576 days.

(21) Appl. No.: 11/609,972

(22) Filed: Dec. 13, 2006

(65) Prior Publication Data

US 2008/0146111 A1 Jun. 19, 2008

(51) Int. Cl.
*H04R 43/02* (2006.01)

(52) U.S. Cl. ..... 29/860; 29/854; 29/877; 313/122; 313/125

(58) Field of Classification Search ..... 29/860, 29/854, 855, 874, 876, 877, 883, 843; 313/122, 313/125
See application file for complete search history.

(56) References Cited

U.S. PATENT DOCUMENTS 3,781,986 A * 1/1974 Joslyn et al. ..... 29/883
6,113,560 A 9/2000 Simnacher
6,849,994 B1 2/2005 White et al.

FOREIGN PATENT DOCUMENTS

JP 05062752 A * 3/1993

* cited by examiner

*Primary Examiner*—A. Dexter Tugbang
(74) *Attorney, Agent, or Firm*—DuBois, Bryant & Campbell, LLP; William D. Wiese

(57) ABSTRACT

A method of repairing a used electrode device 1 is disclosed wherein the method has the steps of providing a used electrode assembly 1 having an inner conductor 9 with an integral electrode tip 3 encapsulated in an insulator body 8 having an outer conductor 10 and an outer electrode tip 4C; and pressing the inner conductor 9 with integral electrode tip 3 while holding or restraining the insulator body 8 to apply an force sufficient to overcome at least partially the adhesion forces at the mating surfaces of the inner conductor 9 and the insulator body 8. Thereafter by grasping an end 9A of the inner conductor 9 opposite the tip 3 while holding the insulator body 8 and withdrawing the inner conductor 9 from the insulator body 8 the parts can be separated. Then by measuring the amount the inner electrode tip 3 has been burnt as compared to a new tapered tip to establish a cut distance ΔX; and recutting the tip 3 by machining the burnt portion along the tip 3 taper surface toward and into a shoulder 3A of the inner conductor 9 by a distance equal to the cut distance ΔX the electrode tip can be reshaped.

4 Claims, 13 Drawing Sheets

METHOD FOR REPAIRING AN ELECTRODE ASSEMBLY

FIELD OF THE INVENTION

The present invention relates to methods to repair used electrode assemblies in acoustic shock wave generating devices such as lithotripters.

BACKGROUND OF THE INVENTION

Acoustic shock waves are created when a high voltage discharge spark passes between two coaxially aligned opposing electrode tips. In the presence of a fluid the energy is released by the spark which flashes the water to steam creating an acoustic wave wherein a series of such waves can pass through tissue to break up concrements within the body.

Preferably, the fluid around the electrode tips is a saline solution to enhance electro conductivity. In some electrode assemblies the fluid surrounding the tips is also charged with carbide particles to further increase conductivity. Such a device is described in U.S. Pat. No. 6,113,560 entitled "Method and Device For Generating Shock Waves For Medical Therapy, Particularly For Electro-Hydraulic Lithotripsy" issued Sep. 5, 2000.

As can easily be appreciated the spark generated by the voltage discharge can create a large amount of heat which tends to burn the tips of the opposing electrode conductors. As the tips burn, the spark gap distance increases resulting in even higher voltages to create a discharge. At some point this dramatically degrades the shock wave pulses generated rendering the electrode assembly non effective. This situation can occur in a very quick time meaning the replacement of the electrode assemblies is done after every second, third or fourth patient procedure. While these devices are adapted for rapid change over or replacement it is also noted that each assembly can cost as much as several hundred dollars.

Accordingly, the device described in U.S. Pat. No. 6,113,560 has been touted as having a longer time of useful capacity and better gap distance maintenance than other similar devices. While this is true, the replacement cost is offset by the high end price demanded for the product.

In U.S. Pat. No. 6,849,994 granted Feb. 1, 2005 in a patent entitled "Electrode Assembly for Lithotripters" the same owner of the U.S. Pat. No. 6,113,560 patent describes the need for refurbishing electrode assemblies used in lithotripters by providing easily replaceable tips. In that patent the inventors noted that a prior art electrode with an insulating layer required the insulating layer to be machined off the inner conductor prior to replacement of the discharge tip and then reapplication of the insulating layer, presumably by remolding the plastic insulating layer over the inner conductor. Naturally this was a labor intensive practice that was cost prohibitive. It was their idea to provide threaded replacement tips that could easily been replaced when burnt to refurbish a used electrode assembly. This, they argued, could greatly reduce replacement cost.

The present inventive method has found a simple quick and very precise method to repair those electrode assemblies without removable tips that were believed to be too costly to repair. No grinding or machining of the insulator layer was required.

The number of such used devices is extremely large and therefore an efficient repair process would be invaluable to the physicians using such a lithotripter having those types of electrode assemblies.

The following description and drawings provide a novel way in which repair of such devices is not only feasible but highly efficient.

SUMMARY OF THE INVENTION

A method of repairing a used electrode device is disclosed wherein the method has the steps of providing a used electrode assembly having an inner conductor with an integral electrode tip encapsulated in an insulator body having an outer conductor and an outer electrode tip; and pressing the inner conductor with integral electrode tip while holding or restraining the insulator body to apply an force sufficient to overcome at least partially the adhesion forces at the mating surfaces of the inner conductor and the insulator body. Thereafter by grasping an end of the inner conductor opposite the tip while holding the insulator body and withdrawing the inner conductor from the insulator body the parts can be separated. Then by measuring the amount the inner electrode tip has been burnt as compared to a new tapered tip to establish a cut distance $\Delta X$; and recutting the tip by machining the burnt portion along the tip taper surface toward and into a shoulder of the inner conductor by a distance equal to the cut distance $\Delta X$ the electrode tip can be reshaped.

The inner conductor further has a shoulder taper surface extending from an end adjacent a base of the integral electrode tip; and the method further includes the step of recutting the shoulder taper shoulder by machining the outside diameter of the inner conductor at a distance $\Delta X$ beyond the intersection of the shoulder taper surface and the diameter of the conductor along the same angle to form a conical surface of the same diametrical dimensions as the original shoulder surface.

In one embodiment the method further includes cutting a pair of legs of the burnt outer electrode at a distance D extending outwardly from the insulator housing to leave two protruding leg portions; placing the insulator body with two protruding leg portions in a half of a split fixture, wherein the slip fixture has two halves each with an interior surface molded or otherwise shaped to replicate the exterior surface of the insulator body; placing an outer electrode with two legs into the fixture wherein the two legs overlap the pair of cut leg portions embedded in the insulator body; setting the distance of the overlap to replicate the proper gap distance; closing the fixture securing the outer electrode against the projecting legs; introducing a pair of welding tips through holes in the fixture exposing the overlapping leg portions; and pressing the welding tip against the legs and welding a leg of the outer tip to the projecting leg portion. This method may also include slipping a pair of insulator tubes over the legs and moving the insulators to a central portion of the electrode prior to placing in the fixture and welding the legs; and moving an insulator over each welded leg portion after welding. Thereafter by re-inserting a recut of an inner conductor into an insulator body and pressing the conductor until fully seated in the insulator body to form an assembly.

This repaired used electrode assembly prior to repairing has an outer sleeve attached to the insulator body, the sleeve being filled with a particle suspended fluid and the sleeve being retained by a metal ring at the location of attachment to the insulator body and prior to the step of removing the inner conductor from the insulator body the method further may require placing the electrode assembly in a fixture with a collet holding the metal ring tin place; pushing on the sleeve to release the ring; and removing the assembly from the fixture and separating the sleeve from the insulator body. Thereafter the step of emptying the fluid into a container while filtering the suspended particles may be used along with the steps of removing a particle holding container from the sleeve; opening the container; recharging the container with particles; and closing the refilled container and reinserting into the sleeve, the sleeve has two vent holes that can be sealed by sealing the vent holes with a tape labeled "remove prior to use"; filling the sleeve with saline solution; placing the metal ring around the sleeve; placing the repaired electrode assembly into the filled sleeve and pressing the metal ring over the sleeve and insulator body joint to tightly seal the assembly.

BRIEF DESCRIPTION OF THE DRAWINGS

The invention will be described by way of example and with reference to the accompanying drawings in which:

FIG. 1A is a perspective view of an assembled electrode.

FIG. 1B is a cross sectional view of the assembled electrode of FIG. 1A.

FIG. 1C is an exploded perspective view of the various components of the electrode assembly of FIG. 1A.

DETAILED DESCRIPTION OF THE INVENTION

Figure 1A:
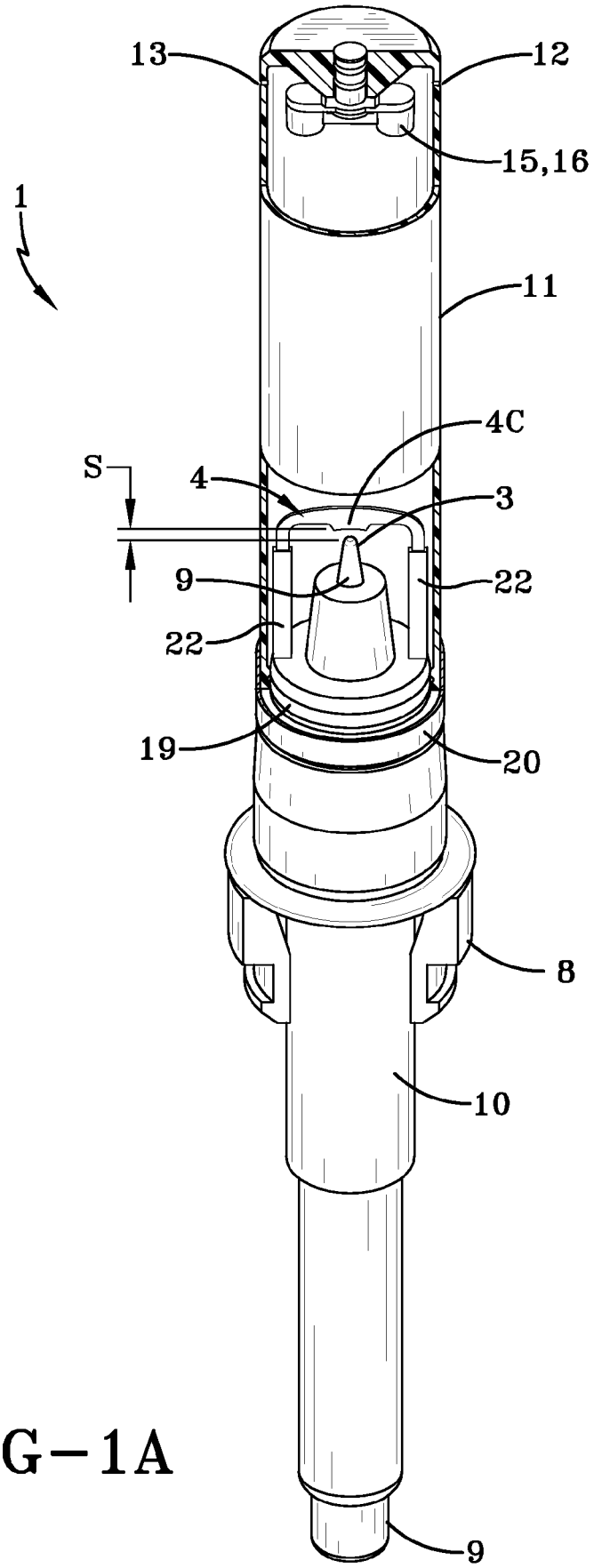
FIGS. 1A, 1B, 1C are views of the electrode assembly.
Figure 1B:
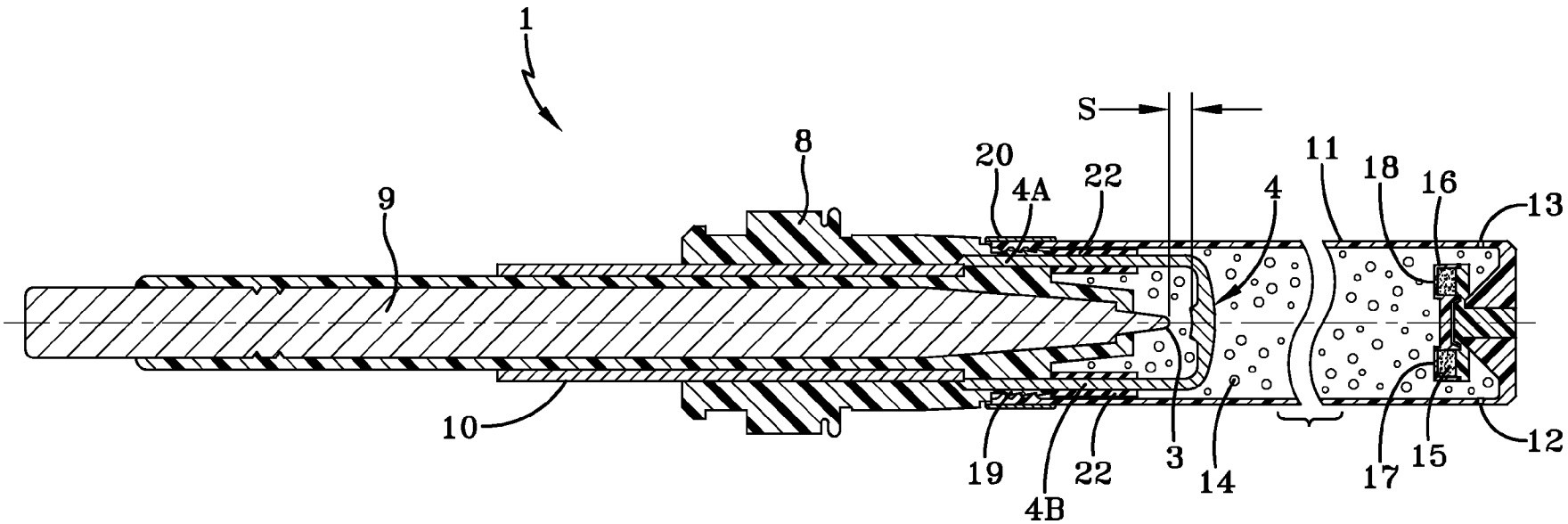
Figure 1C:
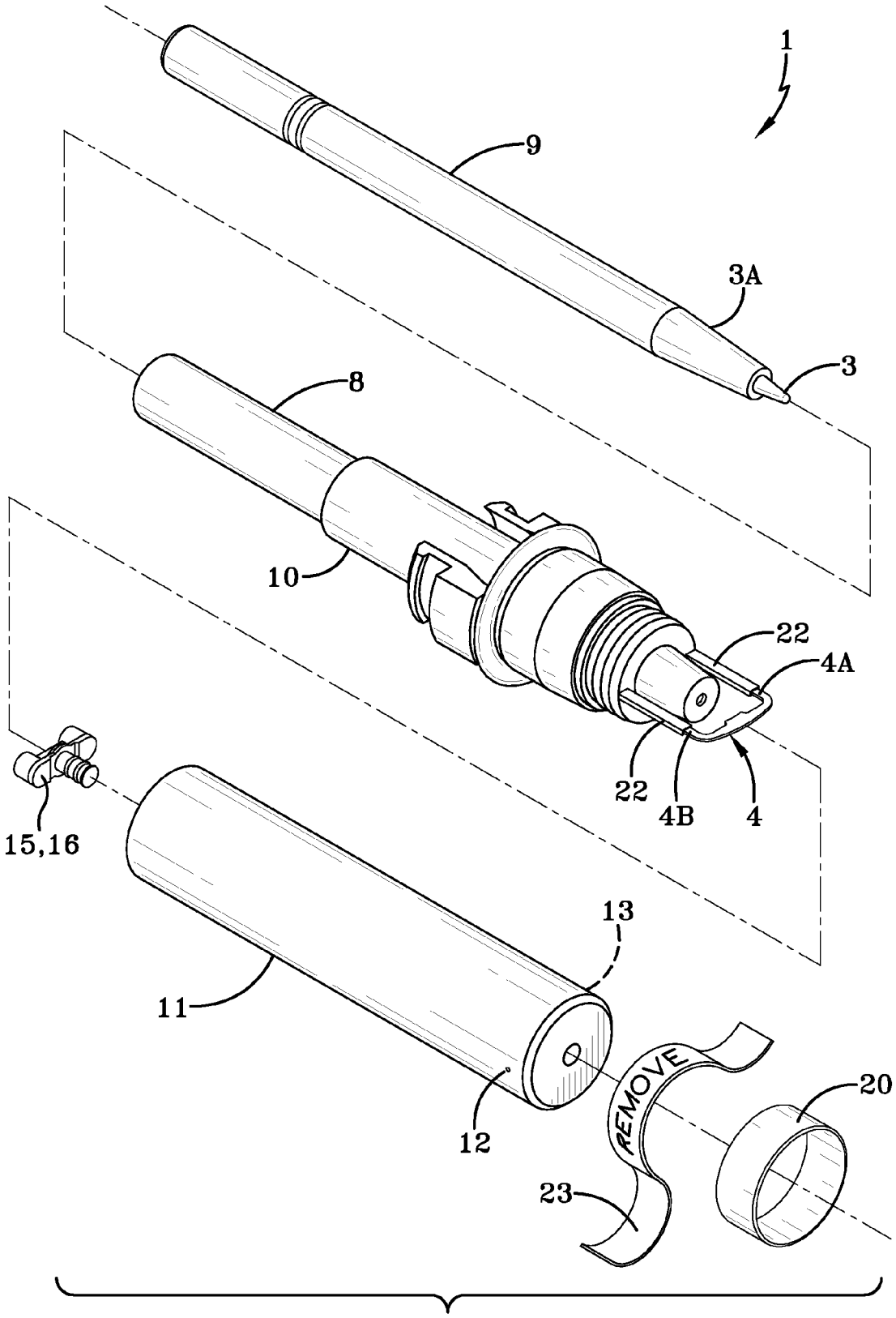

With reference to FIGS. 1A, 1B, 1C an electrode assembly 1 is shown having two electrodes 3, 4. The electrode 3 is connected to an inner conductor 9 embedded in a plastic installation body 8 that has been insert molded around an electrical conductor 9. The electrode 4 is electrically connected to a tubular outer conductor 10. The outer electrode 4 has a pair of legs 4A and 4B connected by a transverse tip portion 4C which has the electrode projecting toward the electrode tip 3. When new this distance is set at a spark gap distance S. The space around the electrodes 3, 4 is surrounded by a sleeve 11 which is permeable to shock waves and has two holes 12 and 13, each of several hundred micrometers in diameter. The sleeve 11 is filled with degassed water 14 that has some level of salinity and has a resistivity of about 2000 ohms by $cm^2$. Particles are placed in the container 16 retained in the sleeve 11, the container 16 holds carbide particles 15 that disperse through two small holes 17, 18 in the container 16 during a shock wave activation. Once activated these particles 15 stay suspended in the saline water 14 and help provide a longer life and higher conductivity of the water 14 for use in the electrode 1. As shown the sleeve 11 sits over the plastic insulator body 8 which has several hose barb circular seal connections 19 such that the sleeve 11 when pressed over the insulator body 8 makes a gripping attachment. To provide a water tight seal, a metal ring 20 is then pressed over the sleeve 11 and the insulator body 8 overlying this region of barb seal connectors 19 making an extremely tight sealed fit. When the electrode 1 has been used to the point that the tips 3 and 4 are sufficiently burnt that the gap S cannot be maintained between the two electrodes 3 and 4 the entire electrode assembly 1 is generally disposed of. It has come to the attention of the present inventors that this process of simply discarding the used electrode 1 is inefficient in that the electrode is capable of many more uses if the electrode tips 3 and 4 can be repaired such that the gap S between the two electrodes 3 and 4 can be maintained. As a result of this discovery it was determined that if the entire electrode assembly 1 could be disassembled in an efficient manner that the electrode tip 3 formed on the metal inner conductor 9 could be repaired as well as repairing the outer electrode 4 such that the spark gap S can be re-established. The following description provides a method of disassembling such an electrode device 1. This device as described above is similar to and is further described in U.S. Pat. No. 6,113,560 which is incorporated herein by reference in its entirety.

Figure 2A:
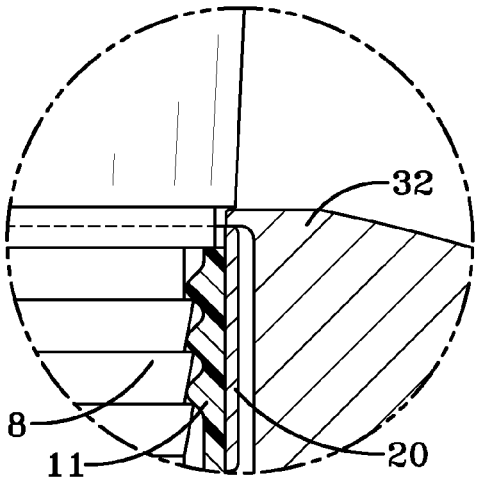
FIG. 2A is an enlarged view of the retaining ring being dislodged.
Figure 2:
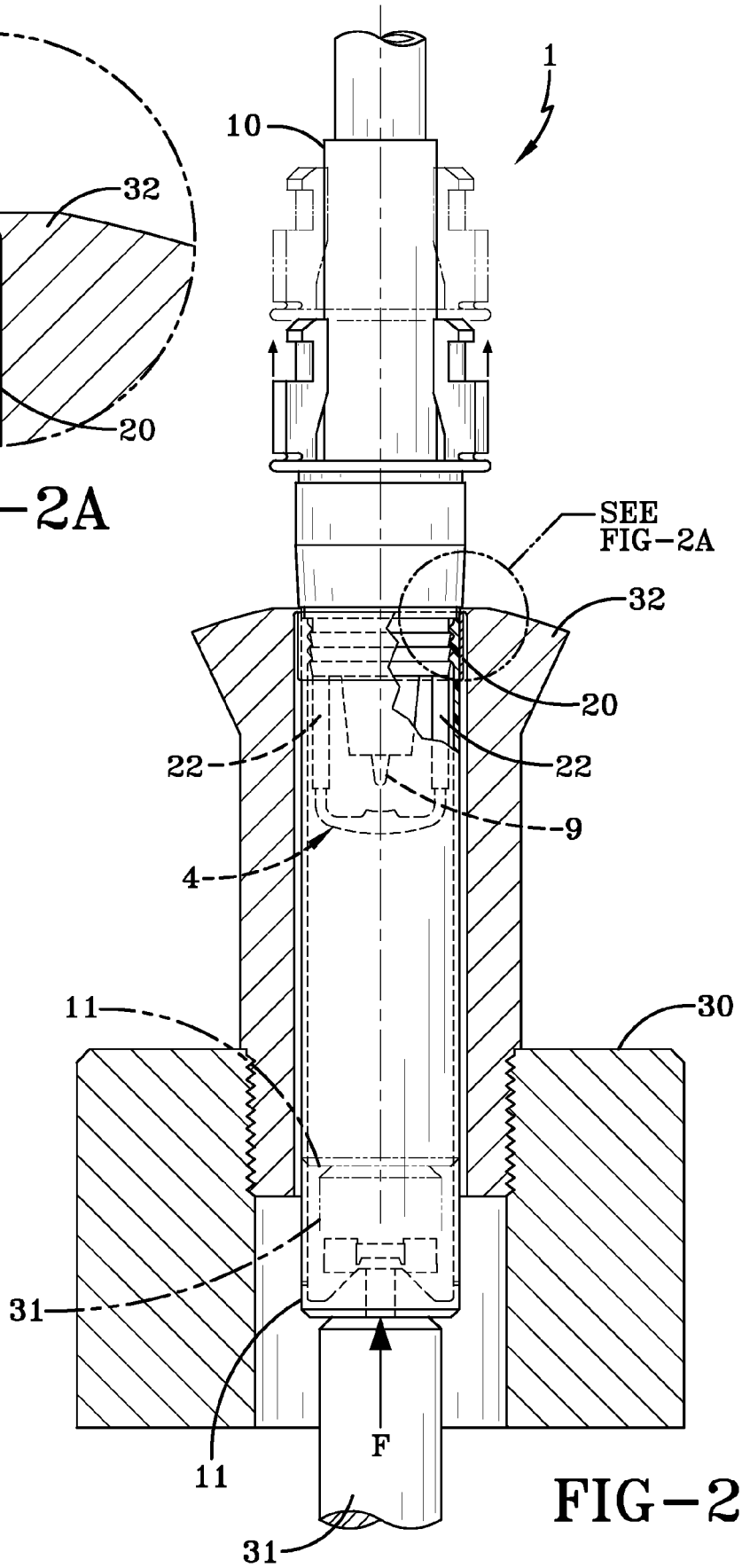
FIG. 2 is a view of an assembly fixture showing how the metal retaining ring is dislodged from the plastic sleeve.

The first step in disassembling the electrode assembly 1 is to place the sleeve 11 in a fixture 30 with a collet collar 32 that grasps the ring 20 holding it in place and thereafter a rod 31 pushes the plastic sleeve 11 free of the ring 20 as shown in FIG. 2. Once the ring 20 is moved from the retention area around the insulator body 8 and sleeve 11 then the operator disassembling the electrode can simply pull apart by twisting and bending off the plastic sleeve relative to the plastic main body housing 8. The fluid 14 contained therein can then be poured into a container and the carbide particles 15 can be salvaged if so desired. Alternatively since the saline water 14 and carbide particles 15 are readily available it is possible to simply replace the saline water 14 and carbide particles 15 with new material.

Figure 3A:
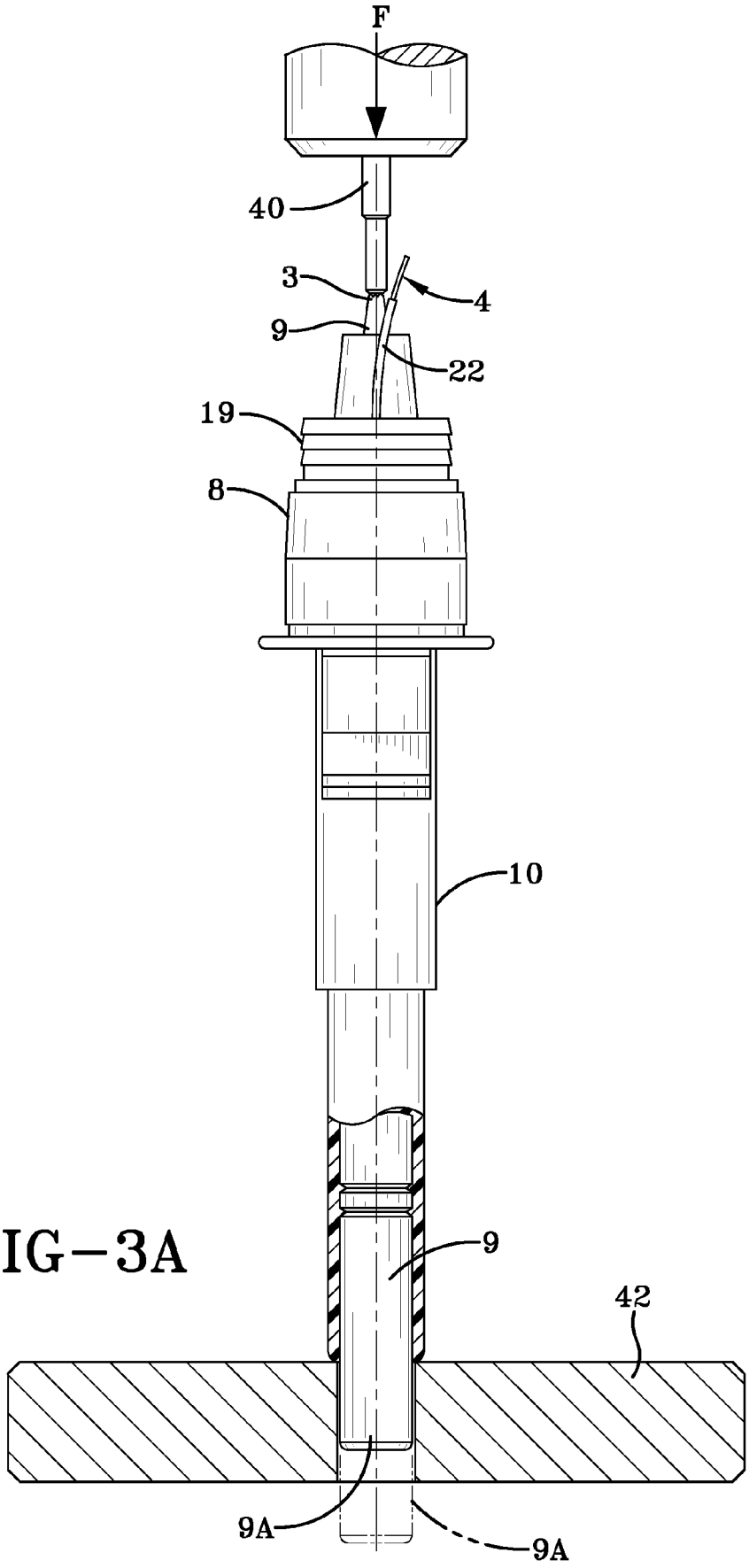
FIG. 3A is a view of the assembly fixture with the plastic sleeve removed placed in a holding fixture and an arbor press for dislodging the insulator body grip on the inner conductor.
Figure 3B:
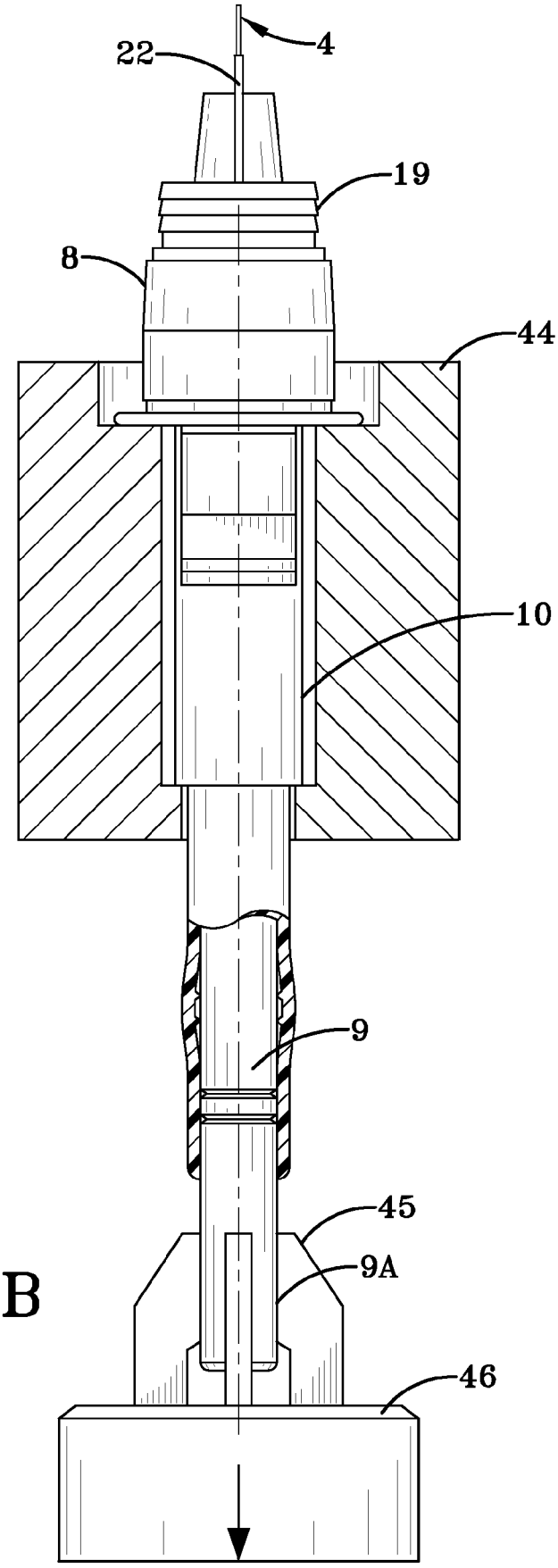
FIG. 3B shows the removal of the inner conductor from the insulator body.

As shown in FIG. 3A, once the sleeve 11 containing fluid 14 is removed the electrode tips 3 and 4 are exposed and the electrode tip 3 which is an integral part of the metal inner conductor 9 can be observed protruding out of the plastic insulator housing body 8 by an amount of approximately an ⅛ to 3⁄16 of an inch (3.2 mm) to (4.8 mm). Accordingly by placing the electrode assembly 1 in a holding fixture 42 and pressing the tip 3 using an arbor press 40 while holding the plastic body 8 restrained in the fixture 42 the operator can force the inner conductor 9 to move in a rearward direction at end location 9A breaking free the insulation grip around the conductor 9. Once the adhesion of the insulator body 8 is overcome the assembly 1 can then be placed in a holder 44 using the 10 mm collet collar 45 retained in a fixture 46 which will hold onto the exposed end 9A of the conductor 9 and the operator can push the plastic insulator body 8 free from the conductor 9 or pull the conductor 9 out of the body 8, as shown in FIG. 3B. At this point the entire conductor 9 with burnt electrode tip 3 has been removed from the insulator body 8. Once removed, the insulator body 8 now simply holds the outer electrode tip 4 which is retained on two projecting legs 4A, 4B and forms a "u" shaped member with the electrode tip 4 in axial alignment with the housing body 8. Upon visual inspection it can be determined whether the electrode tip 4 needs to be replaced, if it does then it is possible to do this in a rather unique manner which will be described below. First a description of the repair of the electrode tip 3 will follow.

Figure 4:
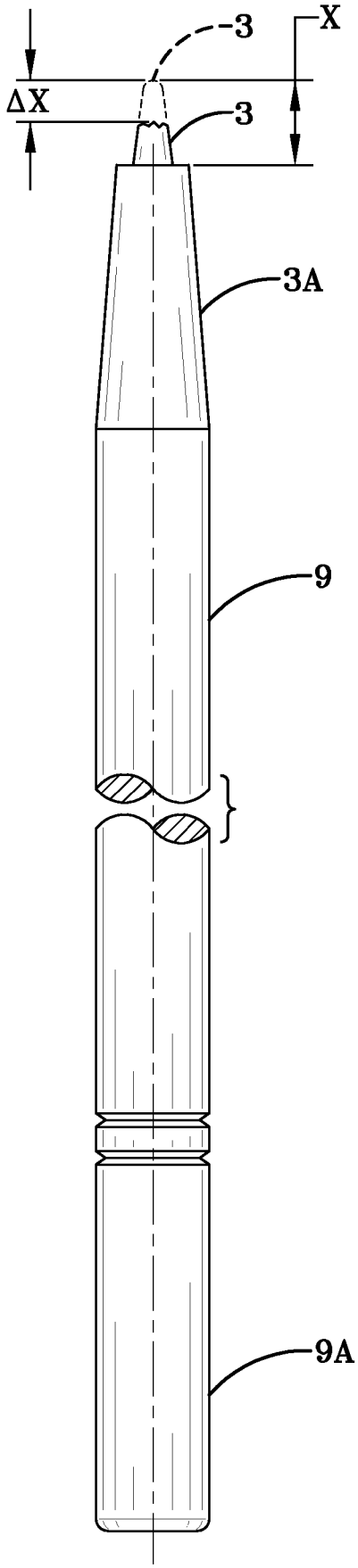
FIG. 4 is a cross sectional view of the inner conductor with integral electrode 3 being measured.
Figure 5:
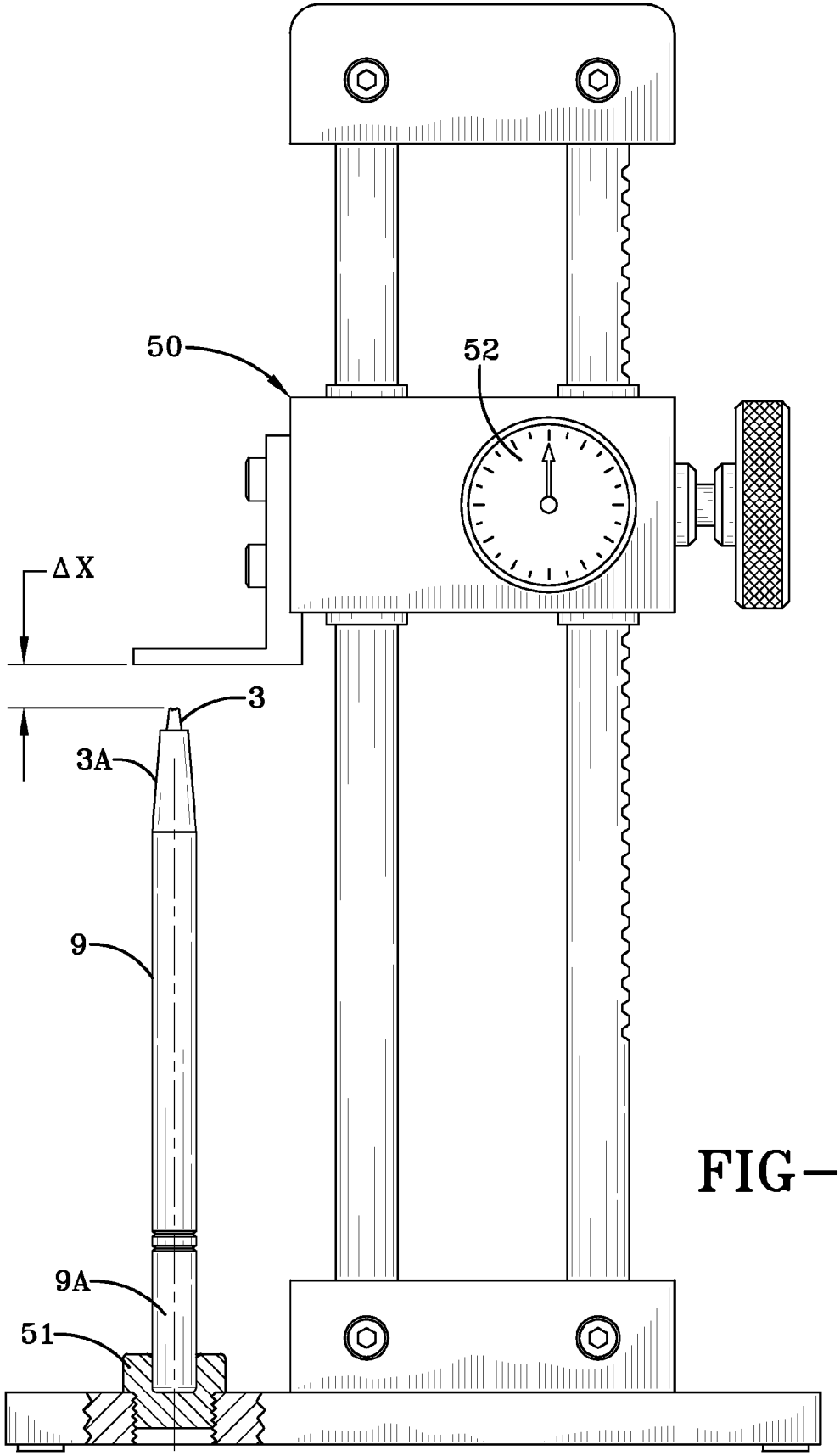
FIG. 5 is a view of a measuring device showing how the burnt tip can be measured.

With reference to FIG. 4 the electrical inner conductor 9 with a burned electrode 3 can be measured so that the amount of burn down can be established. This is done by taking a conductor 9 with a new electrode tip wherein the electrode tip 3 is a conical shape having approximately a 10 degree angle of slope and measuring back to a shoulder 3A for example if a new electrode tip extends a distance X from the shoulder 3A, then the amount of material that has been burned down due to use is determined by measuring the electrode tip extends from the shoulder and the difference ΔX is the amount the tip burnt so that the tip can be recut to the original dimension X. This is possible because the inner conductor 9 extends a sufficient distance beyond what is required to make a good electrical connection when in use. Accordingly it is possible to then take the burnt electrode tip, machine back the shoulder 3A by a distance ΔX with a lathe the 10 degree taper such that the entire tip 3 has been repaired. In order for the electrode conductor 9 to sit properly in the housing body 8 it is then required that the 5 degree shoulder taper must be extended back by the same distance ΔX, such that when the inner electrode conductor 9 is placed back in the plastic housing body 8 it will extend forward a distance sufficient that the tip 3 is precisely back in the location of a new electrode extending the distance X. With reference to FIG. 5, a height measuring device 50 with an indicator dial 52 is set at a precise zero distance such that when the burnt electrode is placed in a fixture 51 the indicator dial 52 can be rotated down to contact the tip 3. This distance of roll down is the amount of burn down ΔX that occurred on the tip 3. Once this dimension is determined it is used to establish the amount of machining required to recut the tip 3 back to the original condition and to reshape the shoulder taper.

Figure 6:
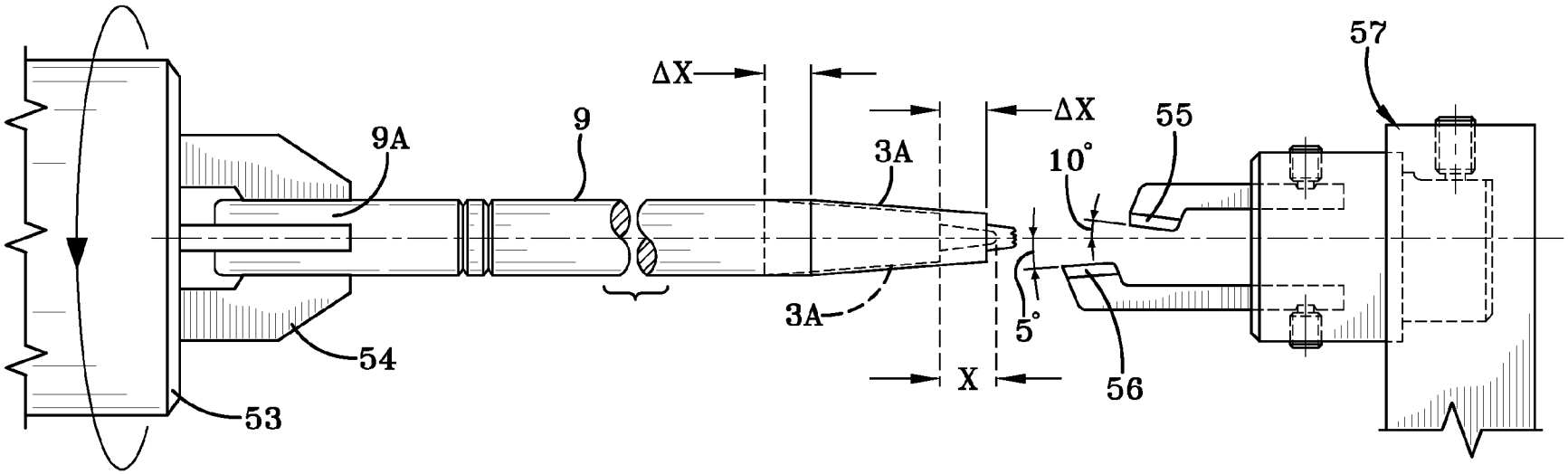
FIG. 6 is a lathe used on the inner conductor so it can be polished and recut to reform the inner electrode tip.

With reference to FIG. 6, during the process of working with the inner conductor 9 while the entire inner conductor 9 is placed in a lathe 53 it is polished using an abrasive pad such that the conductor 9 is sufficiently cleaned prior to cutting back the electrode tip 3 and shoulder by the amount ΔX as desired. As shown the cutters 55, 56 are held at end 57. The tip 3 can be cut after the shoulder end is machined back an amount ΔX after that cut is made the tip is reformed on a 10 angle using a cutter 55. Thereafter the shoulder taper along surface 3A is recut to also extend back a distance ΔX so the conductor 9 will fit precisely in its original position thus finishing the repair of the burnt tip 3. Once cleaned and cut the conductor 9 can then be placed in the container for later reassembly back into the inner layer housing to form a finished electrode product as shown in FIG. 8.

Figure 7A:
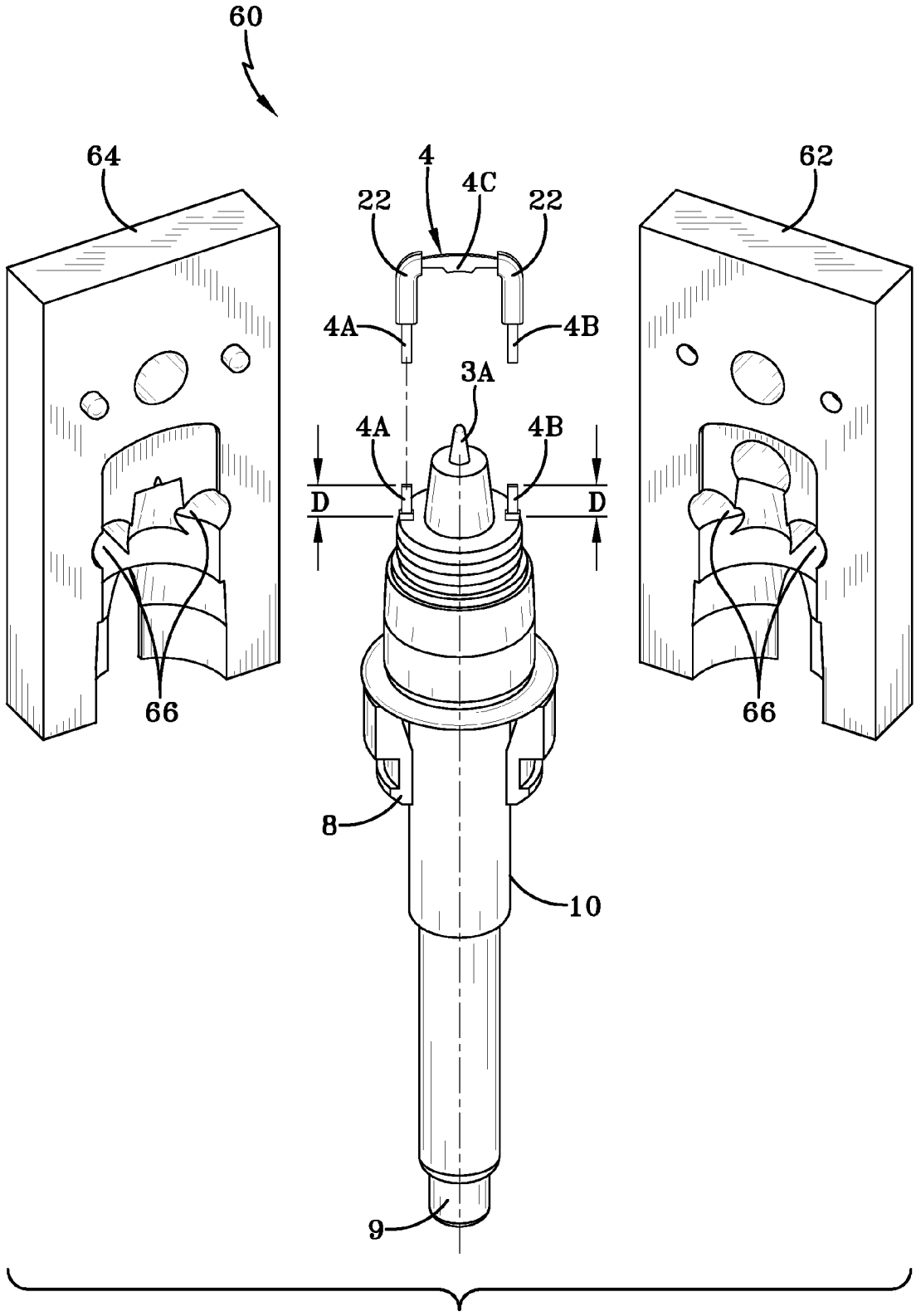
FIG. 7A is a perspective view showing the fixture for holding the outer electrode piece and the insulator body with two cut legs in alignment prior to welding.
Figure 7B:
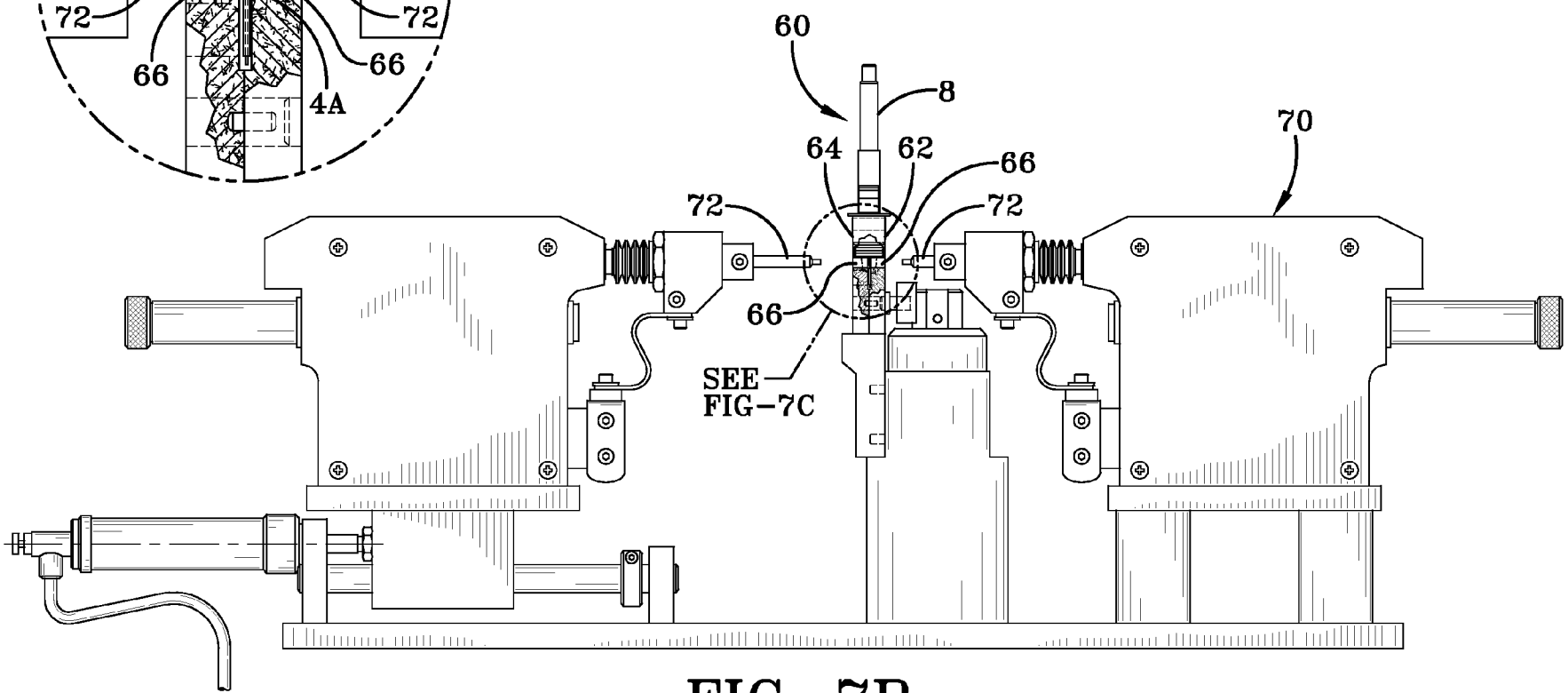
FIG. 7B shows the fixture closed holding the components and the welding tips prior to being positioned through openings in the fixture welding the electrode legs together.
Figure 7C:
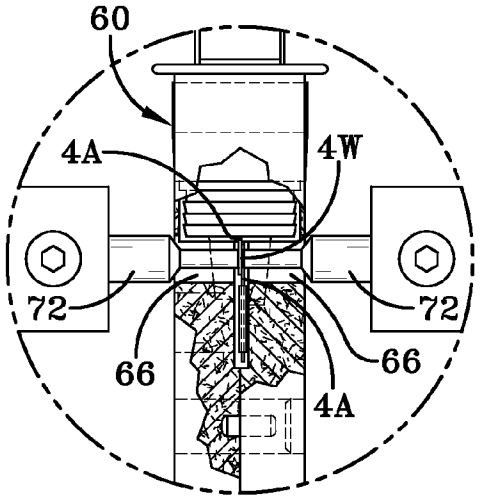
FIG. 7C shows the welding tips positioned through the openings in the fixture to make the weld.

At the other side of the electrode assembly device 1, the electrode tip 4 must be inspected. If the outer electrode tip 4 is sufficiently burnt at the transverse tip portion 4C, then it needs to be repaired in such a fashion that the original gap setting S can be established. In order to accomplish this task the unique method of repairing this electrode device 1 is accomplished by taking two electrode devices 1, where one device has a sufficiently undamaged electrode tip 4 that can be polished and cleaned. On each leg 4A and 4B, of that electrode 4 the legs are cut from the insulator housing body 8 and cleaned as indicated, as shown in FIGS. 7A and 7B. Once cleaned the electrode tip 4 is placed in a fixture 60 and another insulator body 8 with a burnt tip 4 has the electrode legs 4A, 4B cut so that the portion embedded in the plastic body 8 extend and protrude a sufficient distance D from the plastic insulator body 8. These protruding leg portions 4A, 4B on both sides of the insulator body 8 provide a reattachment point for the cut electrode 4. The cut electrode 4 is placed in the fixture 60, the insulator body 8 with two protruding legs 4A, 4B is inserted into this fixture 60 which has split halves 62, 64 of a molded phenolic material that duplicate the outer surfaces of the insulator body 8 by cutting the fixture 60 the split halves 62, 64 can accept and position the legs 4A, 4B of the electrode 4 connected to the insulator body 8 and the cleaned electrode 4 can be brought into contact and alignment with the cut legs overlapping such that the original precise gap S can be set between this assembly. Prior to taking the cut electrode 4 and sticking it in the fixture 60, tubular insulator material two pieces 22 are extended over each leg 4A, 4B and brought to the center arch of the electrode 4 such that the tubular insulation 22 are in position to be set along the sides of the legs 4A, 4B once the cut protruding legs 4A, 4B on the insulating body 8 and the electrode 4 are welded together at location 4W as illustrated in FIGS. 7B and 7C. This is done by welding a projecting out leg 4A on the replacement electrode 4 and welding and then repeating the welding for cut legs 4B to complete the assembly.

As shown in FIG. 7B, a weld machine 70 is provided wherein welding tips 72 are brought into contact with the protruding legs 4A on the insulator body 8 and the repaired and polished electrode 4 legs 4A such that a weld can be made, these welding tips 72 are brought through an opening 66 in the fixture 60 which enables the welding tips 72 to push directly against both pairs of legs 4A to make a secure fitment as a weldement is occurring. Once welded the electrode 4 in the weld zone 4W is generally double the thickness and therefore has improved strength and conductivity in this area. Once the welding is accomplished the fixture 60 can be removed and the insulator tubing pieces 22 can be shoved down over the weldement portions 4W such that the now repaired outer electrode 4 has the appearance of a new electrode 4. As mentioned the gap S is set prior to welding and is precisely set using a feeler gauge to set the depth, once set and the fixture 60 is locked into position and the weld is made such that the protruding legs are in perfect alignment. As shown in FIG. 7A, 7B the inner conductor 9 with a repaired tip 3 is already placed in the housing body during welding. This is optional as the weldement 4W can be made prior to reassembly of the conductor 9 if so desired as described below.

Figure 8:
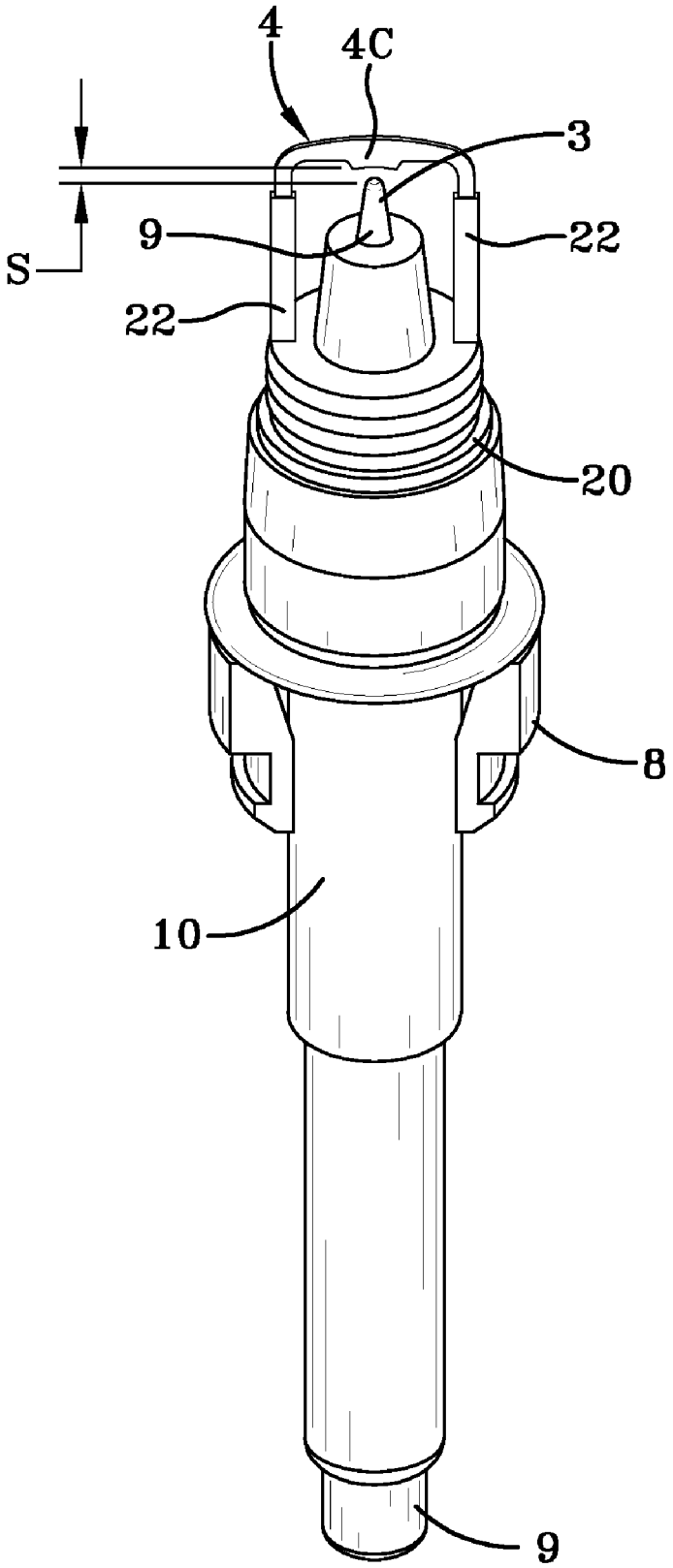
FIG. 8 shows the reassembly of the inner conductor to the insulator housing body.
Figure 9A:
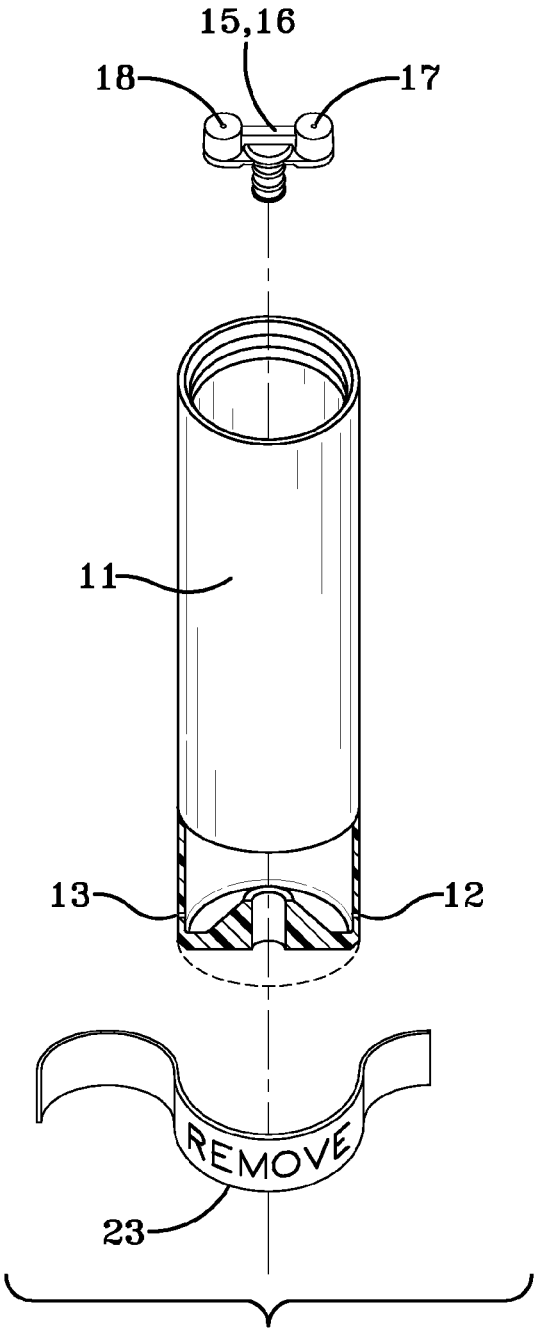
FIG. 9A shows the sleeve having tape placed over the gas vent holes.
Figure 9B:
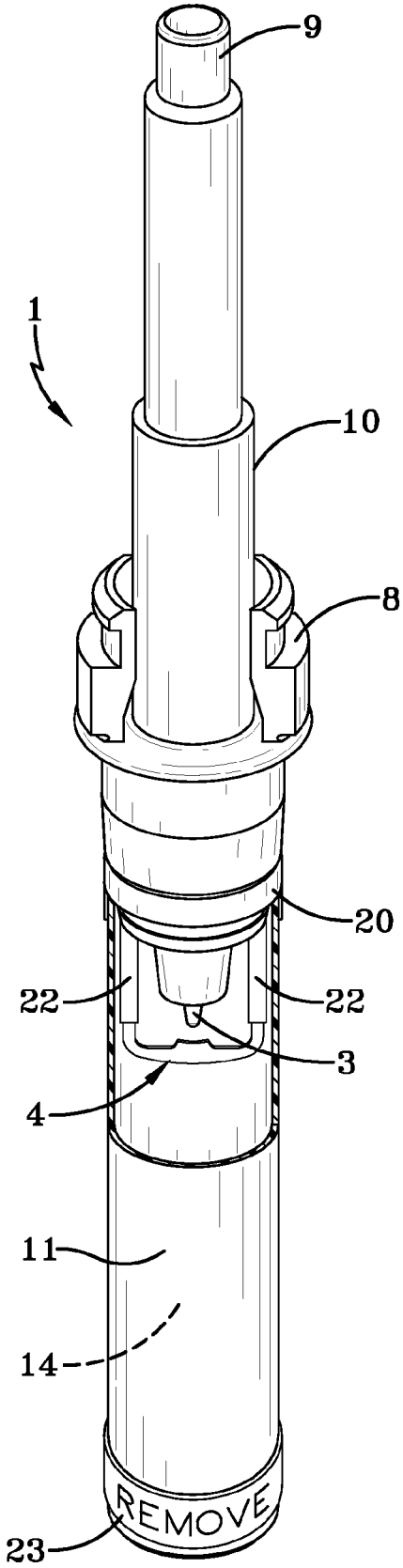
FIG. 9B shows the reassembled electrode.

At this point the electrical inner conductor 9 with a recut electrode tip 3 is placed back into the end of the main insulator body 8 and is pressed fit back into position by placing the electrode 4 in an arbor and having the plastic body 8 in a fixture is possible to smoothly press the conductor 9 back into position as shown in FIG. 8. It is moved forward to a point wherein the assembly is completely set. At this point it is possible to take a feeler gauge and recheck the spark gap S setting to insure that proper positioning has occurred. This fundamentally is automatic as the distances have been precisely cut or welded to the required distances and the inner conductor 9 can only go forward by the amount of material removed along the taper surface. At this point the entire assembly is ready to have the sleeve 11 containing liquid 14 and carbide 15 reattached. Prior to doing so the operator removes the carbide carrier container 16 press fit from its location in the sleeve 11 and repacks it with fresh carbide 15. Also a tape 23 is wrapped around the end of the sleeve 11 covering the 2 micrometer holes 17, 18 that are used for releasing gasses during shock wave treatment as shown in FIG. 9A. This tape 23 is provided with written indication that it must be removed prior to use, once taped and recharged with carbide 15 in the carbide cap carrier container 16 is pressed back into the sleeve 11 and is now ready to have saline solution 14 added. The solution 14 is brought to a fill point on the sleeve 11 and then the filled sleeve 11 and main body 8 are pressed together and thereafter the metal ring 20 is pressed back over the joint interface between the main body 8 and the sleeve 11 creating a water tight seal completing the reassembly of the repaired electrode 1, as shown in FIG. 9B. Once repaired as described above the electrode 1 is placed in a packaging container ready for shipment.

Contrary to what was previously reported by the manufacturer it is not required that the insulator material body 8 be cut or ground from the inner conductor 9, but it can simply be pressed off the inner conductor 9 such that all the components can be repaired, cleaned and reused once the electrode tips 3 and 4 are repaired. These repairs enable the entire device 1 to be repaired in such a fashion that is available for use and the performance characteristics are identical to that of the new electrode. This ability to repair these types of assemblies provides a significant cost savings to the end user. This repaired device provides good spark gap control over a decent amount of use making it desirable that such a device be reusable without requiring an entire new electrode assembly to be purchased, simply because the tips have burnt down slightly and need to be redressed as shown above.

This repair method while requiring several steps to accomplish is fairly simple in its process as described above and as can be seen accomplishes a repair that meets all of the criteria that the original device had maintained when originally sold. Secondly, the method as described above teaches that the outer electrode 4 could be cut from another electrode assembly and reinstalled on a second electrode assembly as described above. However, it is also possible that one does not need to cut the outer electrode 4 along the two legs, but rather can simply clean those electrodes while also removing the inner conductor and recutting the electrode 3 integral thereto as described above as an alternative method of repair. However, it is also possible that one does not need to cut the outer electrode 4 along the two legs, but rather can simply clean those electrodes while also removing the inner conductor and recutting the electrode 3 integral thereto as described as an alternative method of repair.

As an additional alternative repair, it is possible the method described above can provide a new outer electrode 4 of similar shape and construction. The new electrode 4 can be welded onto place as described above to achieve the desired result. In this fashion the cannibalization of two electrode devices 1 to build one electrode device 1 would not be required and the repair process would simply replace the outer electrode such that the assembly can be repaired in that fashion prior to being repackaged and reused. These and other alternative constructions are possible when using the method as described above which unexpectedly and very simply is capable of disassembly and reassembly in such a fashion that these electrode assemblies 1 can be easily repaired and put back into service.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A method of repairing a used electrode device comprising:

providing a used electrode assembly having an inner conductor with an integral electrode tip; the inner conductor being encapsulated in an insulator body having an outer conductor and an outer electrode tip; and pressing the inner conductor with integral electrode tip while holding or restraining the insulator body to apply a force sufficient to disengage the inner conductor from the insulator body;

cutting a pair of legs of a burnt outer electrode at a distance D extending outwardly from the insulator body to leave two protruding leg portions;

placing the insulator body with the two protruding leg portions in a half of a split fixture, wherein the split fixture has two halves each with an interior surface molded or otherwise shaped to replicate an exterior surface of the insulator body;

placing an outer electrode with two legs into the split fixture wherein the two legs of the outer electrode overlap the two protruding leg portions embedded in the insulator body;

setting the distance of the overlap to replicate a proper gap distance;

closing the split fixture securing the outer electrode against the protruding legs;

introducing a pair of welding tips through holes in the split fixture exposing the overlap of the two legs of the outer electrode and the protruding leg portions; and pressing the welding tip against the protruding legs and welding each of the two legs of the outer electrode to each of the protruding leg portions, respectively.

2. The method of claim 1: further comprising:

slipping a pair of insulator tubes over the protruding legs and moving the insulator tubes to a central portion of the outer electrode prior to the placing of the insulator body in the split fixture; and moving the insulator tubes over each of the welded portions of the protruding legs after the welding.

3. The method of claim 2: further comprising:

re-inserting a recut of the inner conductor into the insulator body and pressing the inner conductor until fully seated in the insulator body.

4. The method of claim 3, further comprising:

re-measuring an assembly spark gap distance S of the reassembly parts.

* * * * *